US009196120B2

(12) United States Patent
LeBaron

(10) Patent No.: US 9,196,120 B2
(45) Date of Patent: Nov. 24, 2015

(54) SYSTEM AND METHOD TO AWARD GAMING PATRONS BASED ON ACTUAL FINANCIAL RESULTS DURING GAMING SESSIONS

(71) Applicant: Sycuan Casino, El Cajon, CA (US)

(72) Inventor: Richard G. LeBaron, Alpine, CA (US)

(73) Assignee: SYCUAN CASINO, El Cajon, CA (US)

( * ) Notice: Subject to any disclaimer, the term of this patent is extended or adjusted under 35 U.S.C. 154(b) by 162 days.

(21) Appl. No.: 14/018,226

(22) Filed: Sep. 4, 2013

(65) Prior Publication Data

US 2015/0065228 A1 Mar. 5, 2015

(51) Int. Cl.
*G07F 17/32* (2006.01)

(52) U.S. Cl.
CPC ..... *G07F 17/3244* (2013.01)

(58) Field of Classification Search
USPC ..... 463/25
See application file for complete search history.

(56) References Cited

U.S. PATENT DOCUMENTS

| | | | | |
|---|---|---|---|---|
| 4,669,730 | A * | 6/1987 | Small | A63F 3/081 463/17 |
| 8,087,998 | B2 | 1/2012 | Silvestro | 463/25 |
| 8,366,550 | B2 | 2/2013 | Herrmann et al. | 463/42 |
| 2008/0009341 | A1 | 1/2008 | Walker et al. | 463/25 |
| 2009/0275399 | A1 | 11/2009 | Kelly et al. | 463/27 |
| 2013/0137510 | A1 | 5/2013 | Weber | 463/29 |

* cited by examiner

*Primary Examiner* — Pierre E Elisca
(74) *Attorney, Agent, or Firm* — Pillsbury Winthrop Shaw Pittman LLP

(57) ABSTRACT

This disclosure relates to a system configured to award a gaming patron based on gaming session financial results of the patron. The system may be configured to obtain game play information for the gaming session of the patron. The system may be configured to determine an actual financial amount lost by the patron and a theoretical financial loss amount based on the game play information. The system may use the actual financial loss amount and the theoretical financial loss amount to determine whether the patron is eligible for an award. Responsive to the patron being eligible for an award, the system may determine an award and then award the patron via a mobile computing device associated with the patron. In some implementations, the system may include one or more of a game, a game play sensor, a processor, a mobile computing device, electronic storage, external resources, and/or other components.

22 Claims, 3 Drawing Sheets

SYSTEM AND METHOD TO AWARD GAMING PATRONS BASED ON ACTUAL FINANCIAL RESULTS DURING GAMING SESSIONS

FIELD

This disclosure relates to a system configured to award a gaming patron based on gaming session financial results of the patron.

BACKGROUND

Systems to reward players based on wagers placed during land based casino gaming sessions are known. Typically, such systems provide one or more rewards from a standardized set of rewards to a player when a player's wagering rate (e.g., an amount wagered over time) exceeds a threshold value, regardless of the actual total amount of money won or lost by the player. These systems do not allow system operators to dynamically reward individual players based on individual actual financial results from gaming sessions. Rather the reward thresholds are typically static and do not directly correlate to the experience of an individual player.

SUMMARY

One aspect of the disclosure relates to a system configured to award a gaming patron based on gaming session financial results of the patron. The games may include land-based casino games, online games, and/or other games. The system may be configured to obtain game play information for the gaming session of the patron. The system may be configured to determine an actual financial amount lost by the patron and a theoretical financial loss amount based on the game play information. The system may use the actual financial loss amount and the theoretical financial loss amount to determine whether the patron is eligible for an award. Responsive to the patron being eligible for an award, the system may determine an award and then award the patron via a mobile computing device associated with the patron. The award to the patron may leave the patron with positive feelings even though the patron may have experienced higher than expected (e.g., higher than predicted based on the mathematical odds of the games) losses during the gaming session. In some implementations, the system may include one or more of a game, a game play sensor, a processor, a mobile computing device, electronic storage, external resources, and/or other components.

The games may include one or more individual games played by the patron during a gaming session. The games may include one or more games wherein the patron wagers during play. The games may include one or more land-based casino games, one or more online games, and/or other games. A gaming session may include land-based casino game play, online game play, and/or other game play by the patron during the gaming session.

One or more game play sensors may be configured to generate output signals conveying game play information related to game play by the patron during a gaming session. In some implementations, the game play sensors may be and/or include one or more sensors associated with external resources. For example, the external resources may include a casino management system. The game play sensors may be and/or include one or more sensors associated with the casino management system. The game play information may include financial information, game type information, play duration information, and/or other information.

One or more processors may be configured to execute one or more computer program modules. The computer program modules may comprise one or more of a tracking module, an actual loss module, a theoretical loss module, a trigger module, an award module, a distribution module, and/or other modules.

The tracking module may be configured to obtain the game play information related to game play by the patron during a gaming session. The tracking module may be configured to obtain the game play information via the output signals from the game play sensors, from the external resources (e.g., a casino management system), and/or from other sources. The tracking module may be configured to obtain the game play information in real-time or near real-time during the gaming session of the patron. In some implementations, the tracking module may be configured to accumulate game play information from the individual games played by the patron during a gaming session. In some implementations, the tracking module may be configured to store the game play information in electronic storage and/or in other locations.

The actual loss module may be configured to determine an actual financial loss amount lost by the patron during the gaming session. The actual loss module may be configured to determine the actual financial loss amount from the obtained game play information. The actual financial loss amount may be an actual amount of money lost by the patron.

The theoretical loss module may be configured to determine a theoretical financial loss amount by the patron for the gaming session. The theoretical loss module may be configured to determine the theoretical financial loss amount from the obtained game play information. The theoretical financial loss amount may be representative of the mathematical odds (e.g., the house advantage, the par value, the RTP, etc.) of the one or more games played by the patron during the gaming session, wagers placed by the patron during the gaming session, and/or other information. For example, the theoretical financial loss amount may be an amount of money a casino and/or other games operator/provider may expect to win from a patron during a given gaming session.

The trigger module may be configured to determine whether the patron is eligible for an award based on the actual financial loss amount, the theoretical financial loss amount, information obtained via the external resources, information stored in electronic storage, and/or other information. The trigger module may be configured to determine a first eligibility parameter based on the theoretical financial loss amount. The trigger module may be configured to compare the first eligibility parameter to a first eligibility threshold value. In some implementations, the first eligibility parameter may be the theoretical financial loss amount, and/or other parameters. The first eligibility threshold value may be a pre-determined theoretical financial loss minimum eligibility value, and/or other values.

Responsive to the first eligibility parameter breaching the first eligibility threshold value, the trigger module may be configured to determine a second eligibility parameter based on the actual financial loss amount. In some implementations, the second eligibility parameter may be the actual financial loss amount, and/or other parameters. The trigger module may be configured to compare the second eligibility parameter to a second eligibility threshold value. The second eligibility threshold value may be determined based on the theoretical financial loss amount, the actual financial loss amount, information stored in electronic storage, information obtained via the external resources, and/or other information.

In some implementations, the second eligibility threshold value may be an actual financial loss minimum eligibility value that is determined based on a ratio between the actual financial loss amount and the theoretical financial loss amount. The second eligibility threshold value may be determined by multiplying the pre-determined ratio by the theoretical financial loss amount.

In some implementations, the trigger module may be configured, responsive to the first eligibility parameter not breaching the first eligibility threshold value, to determine the second eligibility parameter (e.g., the actual financial loss amount) and compare the second eligibility parameter to a third eligibility threshold value. The third eligibility threshold value may be a pre-determined minimum financial value (e.g. a pre-set minimum amount of money). In some implementations, the trigger module may determine that the patron is eligible for the award responsive to the second eligibility parameter (e.g., the actual financial loss amount) breaching the third eligibility threshold value (e.g., the pre-determined minimum financial value) even though the first eligibility parameter (e.g. the theoretical financial loss amount) did not breach the first eligibility threshold value (e.g., the pre-determined theoretical financial loss minimum eligibility value).

In some implementations, the trigger module may be configured such that determining whether the patron is eligible for an award may include determining whether one or more session eligibility parameters satisfy one or more session eligibility criteria. A first session eligibility parameter and a first session eligibility criteria may be related to an amount of time between playing of individual games during a gaming session. A second session eligibility parameter and a second session eligibility criteria may be related to a number of games played during a gaming session. For example, the trigger module may determine whether the patron has exceeded a given number of periods of game play (e.g., three) on the same individual game and/or on multiple individual games, wherein a start time of one period of play was not within a given amount of time (e.g., five minutes) after the end time of the previous period of play. In some implementations, the patron may be determined to be eligible for the award responsive to one or more of the session eligibility parameters satisfying one or more of the session eligibility criteria. Thus, a gaming session for which a patron's eligibility for an award is determined may be limited to a number of individual games played and/or an allowable amount of time between games, for example. In some implementations, the determination of whether one or more of the session eligibility parameters satisfied one or more of the session eligibility criteria may be made after the determinations related to the first, second, and/or third eligibility thresholds described above.

The award module may be configured to, responsive to a determination that the patron is eligible for the award, determine the award for the patron. The award module may be configured such that the award determined for the patron is related to a percentage of the actual financial loss amount, a percentage of the difference between the actual financial loss amount and the theoretical financial loss amount, and/or other amounts.

The distribution module may be configured to facilitate distribution of an indication of the determined award to the patron. In some implementations, the distribution module may be configured to wirelessly distribute the indication of the determined award to the patron via a mobile computing device associated with the patron.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
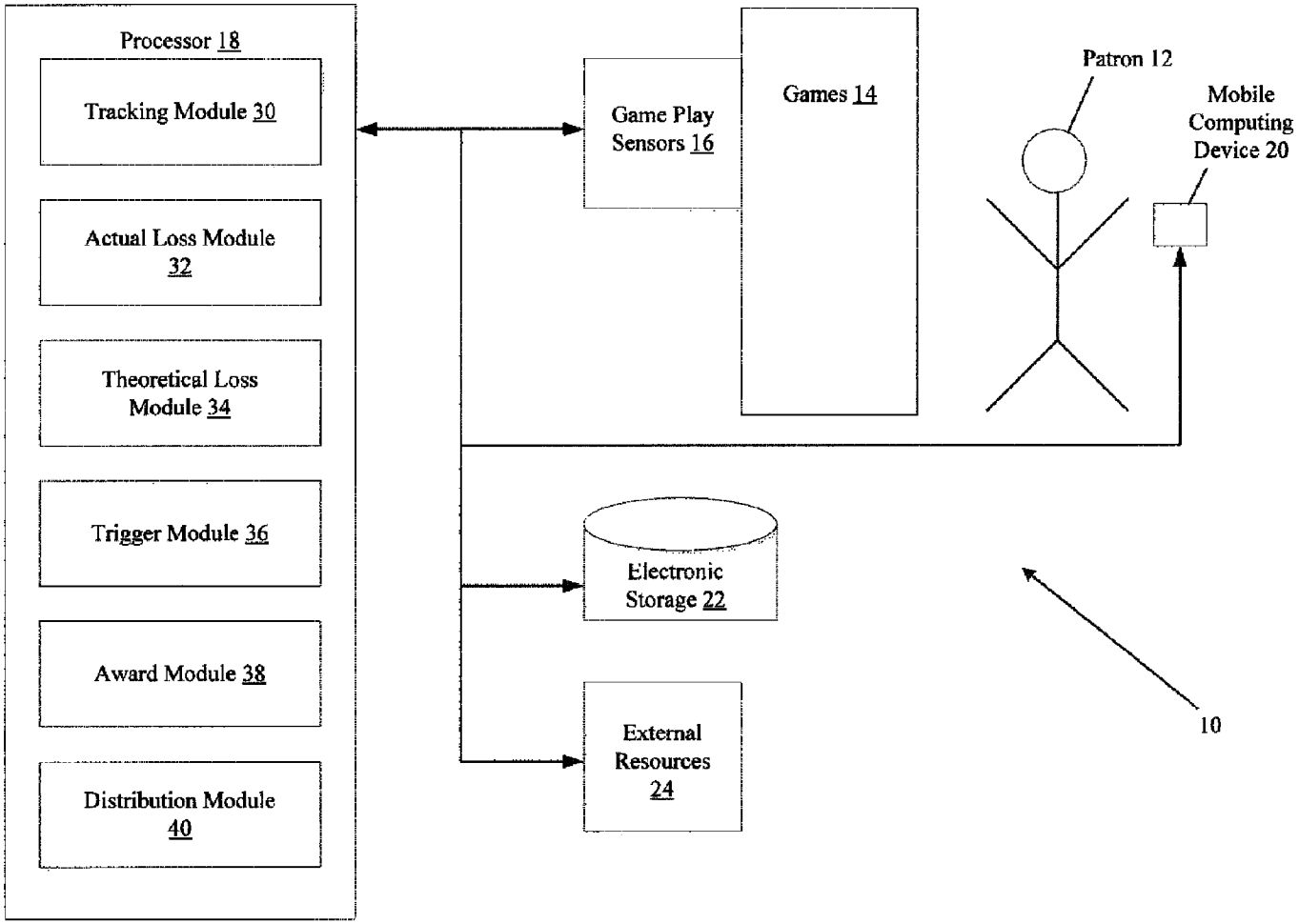
FIG. 1 illustrates a system configured to award a gaming patron based on gaming session financial results of the patron.

FIG. 1 illustrates a system 10 configured to award a gaming patron 12 based on gaming session financial results of patron 12. A gaming session may include patron 12 playing one or more games 14. A gaming session may include patron 12 playing one game 14 for an extended period of time and/or patron 12 playing multiple individual games 14. Games 14 may include land-based casino games, online games, and/or other games. Playing one or more games 14 may include wagering. System 10 may be configured to obtain game play information for the gaming session of patron 12. The game play information may include financial information (e.g., an amount of money won or lost), game type information (e.g., a slot machine, online poker, etc.), play duration information, and/or other information. In some implementations, system 10 may form at least a portion of and/or be in communication with a casino management system (CMS).

System 10 may be configured to determine an actual financial amount lost by patron 12 and a theoretical financial loss amount based on the game play information. The theoretical financial loss amount may be representative of the mathematical odds of games 14 played by patron 12 during the gaming session, wagers by patron 12 during the gaming session, and/or other information. System 10 may use the actual financial loss amount and the theoretical financial loss amount to determine whether patron 12 is eligible for an award. Responsive to patron 12 being eligible for an award, system 10 may determine an award and then award patron 12 via a mobile computing device 20 associated with patron 12.

The eligibility determination and/or the amount awarded to patron 12 may facilitate positive feelings in patron 12 after the gaming session. For example, patron 12 may experience an unusually prolonged period of slot machine losses (e.g., due to slot machine volatility) during a gaming session. The amount awarded to patron 12 after the gaming session may leave patron 12 with positive feelings even though patron 12 may have experienced higher than expected (e.g., higher than predicted based on the mathematical odds of games 14) losses during the gaming session. In some implementations, system 10 may include one or more of a game 14, a game play sensor 16, a processor 18, mobile computing device 20, electronic storage 22, external resources 24, and/or other components.

One or more games 14 may include one or more individual games played by patron 12 during a gaming session. Games 14 may include one or more games wherein patron 12 wagers during play. Games 14 may include one or more land-based casino games, one or more online games, and/or other games. A gaming session may include land-based casino game play, online game play, and/or other game play by patron 12 during the gaming session. The one or more land-based casino games may include games typically found in a land-based casino. The games typically found in a land-based casino may include electronically operated games such as slot machines, video poker, keno, electronic table games, and/or other games. The games typically found in land-based casino may include table games such as blackjack, poker, craps, roulette, and/or other games.

The one or more online games may include games played by patron 12 via the internet and/or other networks. The one or more online games may be played via a computing device associated with patron 12, for example. The one or more online games may include poker, roulette, blackjack, baccarat, bingo, an electronic slot machine, mobile application games, social games, and/or other online games. In some implementations, games 14 may include online and/or land-based sports betting.

One or more game play sensors 16 may be configured to generate output signals conveying game play information related to game play by patron 12 during a gaming session. In some implementations, game play sensors 16 may be and/or include one or more sensors associated with external resources 24. For example, external resources 24 may include a casino management system. Game play sensors 16 may be and/or include one or more sensors associated with the casino management system. The game play information may include financial information, game type information, play duration information, and/or other information. The financial information may include a number of wagers placed by patron 12, the amounts of the wagers placed by patron 12, an amount of money won or lost by patron 12 after each wager, and/or other financial information. The game type information may include information that identifies one or more different games played by patron 12 during a gaming session (e.g., slot machines, online poker, etc.), information that identifies an individual game 14 (e.g., an individual penny slot machine, an individual quarter slot machine), information related to the mathematical odds (e.g., the house advantage, the par value, the return to player (RTP), etc.) of games 14 played by patron 12, and/or other information. The play duration information made include individual lengths of time patron 12 plays individual games 14, a length of the overall gaming session, and/or other play duration information.

In some implementations, game play sensor 16 may include and/or be related to manual observation of the game play of patron 12. Manual observation may be necessary when games 14 include table games as described above. For example, a casino employee may observe patron 12 playing blackjack at a table. The casino employee may enter and/or record the game play information related to the blackjack play of patron 12 via a user interface of the casino management system, for example.

Game play sensors 16 may be adjacent to, coupled with, and/or otherwise in communication with games 14. Game play sensors 16 may include sensors configured to generate output signals related to physical actions by patron 12 during game play (e.g., inserting money, operating buttons), software applications in communication with games 14, cameras configured to generate visual images of game play by patron 12, casino management system sensors integrated with in slot machine player club card readers (e.g., via MSR or smart card technologies such as RFID, NFC, and/or Bluetooth), and/or other sensors. In some implementations, game play sensors 16 may include software (e.g., configured to receive log in information), readers configured to read identification devices (e.g., a player's club card), and/or other sensors configured to generate output signals that identify patron 12 and/or play by patron 12 at an individual game 14. In some implementations, game play sensors 16 may be configured to generate output signals continuously, at regular intervals, and/or at other times while patron 12 plays one or more individual games during the gaming session of patron 12.

Although sensors 16 are depicted in FIG. 1 as a single element, this is not intended to be limiting. Sensors 16 may include one or more sensors located adjacent to, coupled with, and/or in communication with various individual ones of games 14. For example, in some implementations, system 10 may be configured such that a first sensor is in communication with a slot machine played by patron 12, and a second sensor generates output signals related to an online poker game played by patron 12.

As shown in FIG. 1, processor 18 may be configured to execute one or more computer program modules. The computer program modules may comprise one or more of a tracking module 30, an actual loss module 32, a theoretical loss module 34, a trigger module 36, an award module 38, a distribution module 40, and/or other modules.

Tracking module 30 may be configured to obtain the game play information related to game play by patron 12 during a gaming session. Tracking module 30 may be configured to obtain the game play information via the output signals from game play sensors 16, from external resources 24 (e.g., a casino management system), and/or from other sources. Tracking module 30 may be configured to obtain the game play information in real-time or near real-time during the gaming session of patron 12. In some implementations, tracking module 30 may be configured to accumulate game play information from the individual games 14 played by patron 12 during a gaming session. In some implementations, tracking module 30 may be configured to store the game play information in electronic storage 22 and/or in other locations.

By way of a non-limiting example, tracking module 30 may obtain, for a given gaming session, game play information indicating that patron 12 placed twenty individual five dollar wagers while playing a first slot machine with an RTP of 90% or 0.90 (house advantage and/or par value of 10% or 0.10) followed by one hundred individual one dollar wagers while playing a second slot machine that has an RTP of 95% or 0.95 (house advantage and/or par value of 5% or 0.05). The game play information may indicate that patron 12 lost every wager.

Actual loss module 32 may be configured to determine an actual financial loss amount lost by patron 12 during the gaming session. Actual loss module 32 may be configured to determine the actual financial loss amount from the obtained game play information. The actual financial loss amount may be an actual amount of money lost by patron 12 (e.g., an amount of money not returned to patron 12 during game play). The actual financial loss amount lost by patron 12 may be the summation of losses from the individual wagers placed by patron 12 for all games played during the gaming session, less any winnings. Continuing with the example above, patron 12 lost a total of $200 (twenty individual five dollar wagers plus one hundred individual one dollar wagers). Patron 12 did not win a single wager. Therefore, the actual financial loss amount for patron 12 in this example is $200.

Theoretical loss module 34 may be configured to determine a theoretical financial loss amount by patron 12 for the gaming session. Theoretical loss module 34 may be configured to determine the theoretical financial loss amount from the obtained game play information. The theoretical financial loss amount may be representative of the mathematical odds (e.g., the house advantage, the par value, the RTP, etc.) of the one or more games 14 played by patron 12 during the gaming session, wagers placed by patron 12 during the gaming session, and/or other information. For example, the theoretical financial loss amount may be an amount of money a casino and/or other games 14 operator/provider may expect to win from patron 12 during a given gaming session. In some implementations, the theoretical financial loss amount may be determined by multiplying the total amount wagered by patron 12 by the house advantage, multiplying by one minus the RTP, and/or other factors. In some implementations, theoretical loss module 34 may be configured to determine individual theoretical financial losses for each individual game played by patron 12 during the gaming session (e.g., when the individual games each have a different RTP) and then determine a total theoretical financial loss amount based on the individual determinations.

Continuing with the example above, theoretical loss module 34 may determine a first theoretical financial loss amount from the first slot machine of $10 (house advantage of 10% multiplied by $100 in total wagers) and a second theoretical financial loss amount from the second slot machine of $5 (house advantage of 5% multiplied by $100 in total wagers) for a total theoretical financial loss amount of $15.

Trigger module 36 may be configured to determine whether patron 12 is eligible for an award based on the actual financial loss amount, the theoretical financial loss amount, information obtained via external resources 24, information stored in electronic storage 22, and/or other information. Trigger module 36 may be configured to determine a first eligibility parameter based on the theoretical financial loss amount. Trigger module 36 may be configured to compare the first eligibility parameter to a first eligibility threshold value. In some implementations, the first eligibility parameter may be the theoretical financial loss amount, and/or other parameters. The first eligibility threshold value may be a pre-determined theoretical financial loss minimum eligibility value, and/or other values. The pre-determined theoretical financial loss minimum eligibility value may be programmed at manufacture, obtained by trigger module 36 via external resources 24, and/or obtained by other methods. For example, a pre-determined theoretical financial loss minimum eligibility value of $50 may by entered and/or selected via a user interface that is included in external resources 24 by an operator of a casino management system. Trigger module 36 may compare the theoretical financial loss amount determined by theoretical loss module 34 to the exemplar $50 pre-determined theoretical financial loss minimum eligibility value.

Responsive to the first eligibility parameter breaching the first eligibility threshold value, trigger module 36 may be configured to determine a second eligibility parameter based on the actual financial loss amount. In some implementations, the second eligibility parameter may be the actual financial loss amount, and/or other parameters. Trigger module 36 may be configured to compare the second eligibility parameter to a second eligibility threshold value. The second eligibility threshold value may be determined based on the theoretical financial loss amount, the actual financial loss amount, information stored in electronic storage 22, information obtained via external resources 24, and/or other information. In some implementations, the second eligibility threshold value may be an actual financial loss minimum eligibility value that is determined based on a ratio between the actual financial loss amount and the theoretical financial loss amount. The second eligibility threshold value may be determined by multiplying the pre-determined ratio by the theoretical financial loss amount. In some implementations, the ratio between the actual financial loss amount and the theoretical financial loss amount may be a pre-determined ratio programmed at manufacture, obtained by trigger module 36 via external resources 24, and/or obtained by other methods.

For example, a pre-determined ratio of 3.0 may by entered and/or selected via the user interface that is included in external resources 24 (e.g., by the operator of the casino management system described in the example above). Trigger module 36 may be configured to determine the second eligibility threshold value (e.g., the actual financial loss minimum eligibility value) by multiplying 3.0 by the theoretical financial loss amount. Trigger module 36 may be configured to determine that patron 12 is eligible for the award responsive the first eligibility parameter (e.g. the theoretical financial loss amount) breaching the first eligibility threshold value (e.g., the pre-determined theoretical financial loss minimum eligibility value) and the second eligibility parameter (e.g., the actual financial loss amount) breaching the second eligibility threshold value (e.g., the actual financial loss minimum eligibility value).

By way of another non-limiting example, actual loss module 32 may determine an actual financial loss amount of $227.52 and theoretical loss module 34 may determine a theoretical financial loss amount of $67.05 for game play by a given patron 12 during a gaming session. Trigger module 36 may determine that the theoretical financial loss amount of $67.05 exceeds the pre-determined theoretical financial loss minimum eligibility value example of $50 (e.g., the first eligibility parameter has breached the first eligibility threshold value). Trigger module 36 may determine that the actual financial loss amount of $227.52 exceeds an actual financial loss minimum eligibility value of $201.15 (e.g., a ratio of 3.0 multiplied by $67.05 is $201.15). Trigger module 36 may be configured to determine that patron 12 is eligible for the award because the theoretical financial loss amount of $67.05 breached the pre-determined theoretical financial loss minimum eligibility value of $50 and the actual financial loss amount of $227.52 breached the actual financial loss minimum eligibility value of $201.15.

In some implementations, the ratio between the actual financial loss amount and the theoretical financial loss amount may be different for different types of games 14 played by patron 12. For example, the ratio for table games may be different that the ratio for slot machine play. Ratios for individual table games (e.g., poker vs. blackjack) may also be different from each other. The second eligibility threshold value may be determined based on the individual ratios for the individual games. For example, for a gaming session wherein patron 12 played a slot machine and blackjack, the second eligibility threshold value may be determined based on a first eligibility threshold value determined for slot machine play of patron 12 (e.g., a slot machine ratio multiplied by a slot machine theoretical financial loss) and a second eligibility threshold value determined for blackjack play of patron 12 (e.g., a blackjack ratio multiplied by a blackjack theoretical financial loss). In some implementations, the second eligibility threshold value may be an average and/or other combination of the individual game eligibility threshold values. Continuing with the prior example, the second eligibility threshold value may be determined by multiplying the pre-determined ratio for blackjack by the theoretical financial loss amount for blackjack, multiplying the pre-determined ratio for slot play by the theoretical financial loss amount for blackjack, then adding the blackjack eligibility threshold value to the slot machine eligibility threshold value, and dividing by two.

In some implementations, trigger module 36 may be configured, responsive to the first eligibility parameter not breaching the first eligibility threshold value, to determine the second eligibility parameter (e.g., the actual financial loss amount) and compare the second eligibility parameter to a third eligibility threshold value. The third eligibility threshold value may be a pre-determined minimum financial value (e.g. a pre-set minimum amount of money). In some implementations, the pre-determined minimum financial value may be programmed at manufacture, obtained by trigger module 36 via external resources 24, and/or obtained by other methods. For example, a pre-determined minimum financial value of $200 may by entered and/or selected via the user interface that is included in external resources 24 (e.g., by the operator of the casino management system described in the examples above). Trigger module 36 may obtain the pre-determined minimum financial value responsive to the $200 entry and/or selection. Trigger module 36 may compare the actual financial loss amount to the exemplar $200 pre-determined minimum financial value. In some implementations, trigger module 36 may determine that patron 12 is eligible for the award responsive to the second eligibility parameter (e.g., the actual financial loss amount) breaching the third eligibility threshold value (e.g., the pre-determined minimum financial value) even though the first eligibility parameter (e.g. the theoretical financial loss amount) did not breach the first eligibility threshold value (e.g., the pre-determined theoretical financial loss minimum eligibility value).

By way of a third non-limiting example, actual loss module 32 may determine an actual financial loss amount of $457.00 and theoretical loss module 34 may determine a theoretical financial loss amount of $49.08 for game play by a given patron 12 during a gaming session. Trigger module 36 may determine that the theoretical financial loss amount of $49.08 does not exceed the pre-determined theoretical financial loss minimum eligibility value example of $50 (e.g., the first eligibility parameter has not breached the first eligibility threshold value). Trigger module 36 may then determine that the actual financial loss amount of $457.00 exceeds the pre-determined minimum financial value example of $200.00. Trigger module 36 may be configured to determine that patron 12 is eligible for the award because the actual financial loss amount of $457.00 breached the pre-determined minimum financial value of $200.00.

In some implementations, trigger module 36 may be configured such that determining whether patron 12 is eligible for an award may include determining whether one or more session eligibility parameters satisfy one or more session eligibility criteria. A first session eligibility parameter and a first session eligibility criteria may be related to an amount of time between playing of individual games 14 during a gaming session. A second session eligibility parameter and a second session eligibility criteria may be related to a number of games played during a gaming session. For example, trigger module 36 may determine whether patron 12 has exceeded a given number of periods of game play (e.g., three) on the same individual game 14 and/or on multiple individual games 14, wherein a start time of one period of play was not within a given amount of time (e.g., five minutes) after the end time of the previous period of play. In some implementations, patron 12 may be determined to be eligible for the award responsive to one or more of the session eligibility parameters satisfying one or more of the session eligibility criteria. Thus, a gaming session for which a patron's (e.g. patron 12) eligibility for an award is determined may be limited to a number of individual games played and/or an allowable amount of time between games, for example. In some implementations, the determination of whether one or more of the session eligibility parameters satisfied one or more of the session eligibility criteria may be made after the determinations related to the first, second, and/or third eligibility thresholds described above.

Figure 2:
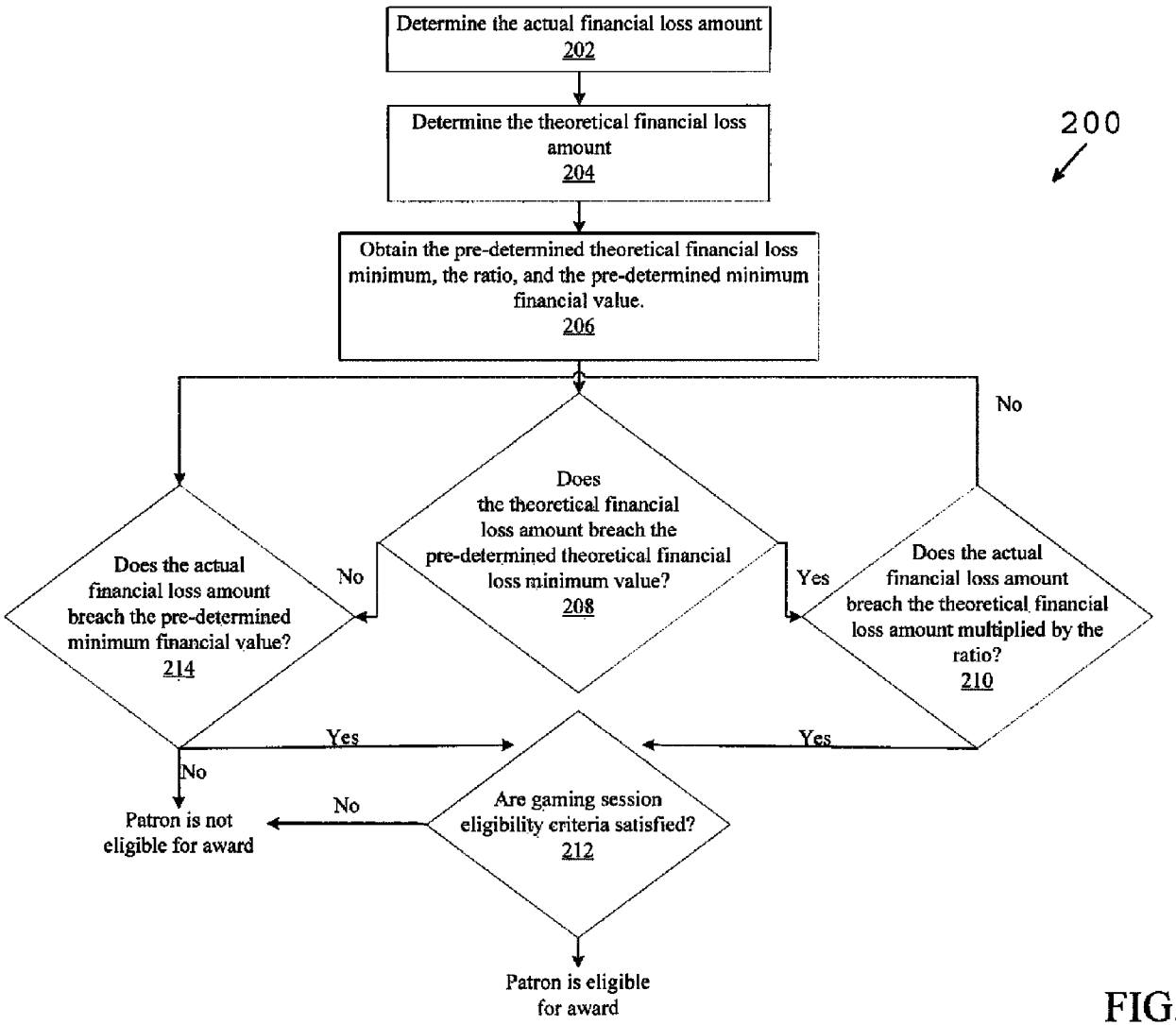
FIG. 2 illustrates a conditional evaluation flow for determining the eligibility of a patron for an award.

FIG. 2 illustrates a conditional evaluation flow 200 for determining the eligibility of a patron (e.g., patron 12) for an award. FIG. 2 may summarize at least a portion of the functionality attributed to actual loss module 32, theoretical loss module 34, trigger module 36, and/or other modules described herein with respect to FIG. 1. For example, step 202, may be performed by actual loss module 32 (shown in FIG. 1 and described above). Step 204, may be performed by theoretical loss module 34 (shown in FIG. 1 and described above). Steps 206, 208, 210, 212, and 214 may be performed by trigger module 36 (shown in FIG. 1 and described above). FIG. 2 is not intended to be limiting. For example, conditional evaluation flow 200 may include additional steps not shown in FIG. 2, less steps than are shown in FIG. 2, linkages not shown in FIG. 2, and/or different linkages than those shown in FIG. 2.

Returning to FIG. 1, award module 38 may be configured to, responsive to a determination that patron 12 is eligible for the award, determine the award for patron 12. Award module 38 may be configured such that the award determined for patron 12 is related to a percentage of the actual financial loss amount, a percentage of the difference between the actual financial loss amount and the theoretical financial loss amount, and/or other amounts. In some implementations, the percentage of the actual financial loss amount and/or the percentage of the difference between the actual financial loss amount and the theoretical financial loss amount may be pre-determined. In some implementations, the pre-determined percentages may be programmed at manufacture, obtained by award module 38 via external resources 24, and/or obtained by other methods. For example, a pre-determined percentage of 10% for the percentage of the difference between the actual financial loss amount and the theoretical financial loss amount may by entered and/or selected via the user interface that is included in external resources 24 (e.g., by the operator of the casino management system described in the examples above). In some implementations, the award may be monetary (e.g. a cash award), related to free game play of games 14, related to and/or include player's club points associated with a casino, related to and/or include coupons associated with a casino, and/or other awards.

In some implementations, award module 38 may be configured to obtain a pre-determined maximum award amount. In some implementations, the maximum award amount may be programmed at manufacture, obtained by award module 38 via external resources 24, and/or obtained by other methods. For example, a pre-determined maximum award amount of $25 may by entered and/or selected via the user interface that is included in external resources 24 (e.g., by the operator of the casino management system described in the examples above). Award module 38 may be configured such that the award to patron 12 does not exceed the maximum award amount. In this example, even if an award was determined to be $40, award module 38 may limit the award to the $25 maximum award amount. In some implementations, award module 38 may round an award to the nearest dollar and/or other monetary amount.

For example, award module 38 may determine, responsive to a determination that patron 12 is eligible, an award based on a pre-determined percentage of 10% (e.g., obtained via external resources 24), an actual financial loss amount of $227.52 (as in one of the examples given above), a theoretical financial loss amount of $67.05 (also as in one of the examples given above), and a maximum award amount of $25. Award module 38 may determine an award of $16.05 (e.g., less than the maximum award amount of $25) by subtracting $67.05 from $227.52 and then multiplying by 10% (e.g., ($227.52−$67.05)×0.10=$16.05). Award module 38 may round the award to $16.

Distribution module 40 may be configured to facilitate distribution of an indication of the determined award to patron 12. In some implementations, distribution module 40 may be configured to wirelessly distribute the indication of the determined award to patron 12 via mobile computing device 20 associated with patron 12. Wireless distribution of the indication of the award may include sending a text, sending an email, tweeting, posting to social media (e.g., Facebook), and/or other wireless distribution. In some implementations, patron 12 may also receive the indication of the determined award via a casino website (e.g., either informational and/or an online casino website where patron 12 has the ability to log in to view his or her specific account information, and/or where a players club account associated with patron 12 is linked to such a website). The indication of the determined award may be and/or include a message conveying information related to the determined award. Distribution module 40 may facilitate the wireless distribution via a cellular network, a Wi-Fi network, the internet, and/or other networks. In some implementations, distribution module 40 may be configured to facilitate distribution of the indication of the award via mail and/or other non-wireless methods. For example, distribution module 40 may facilitate the distribution of coupons related to the determined award via mail.

Figure 3:
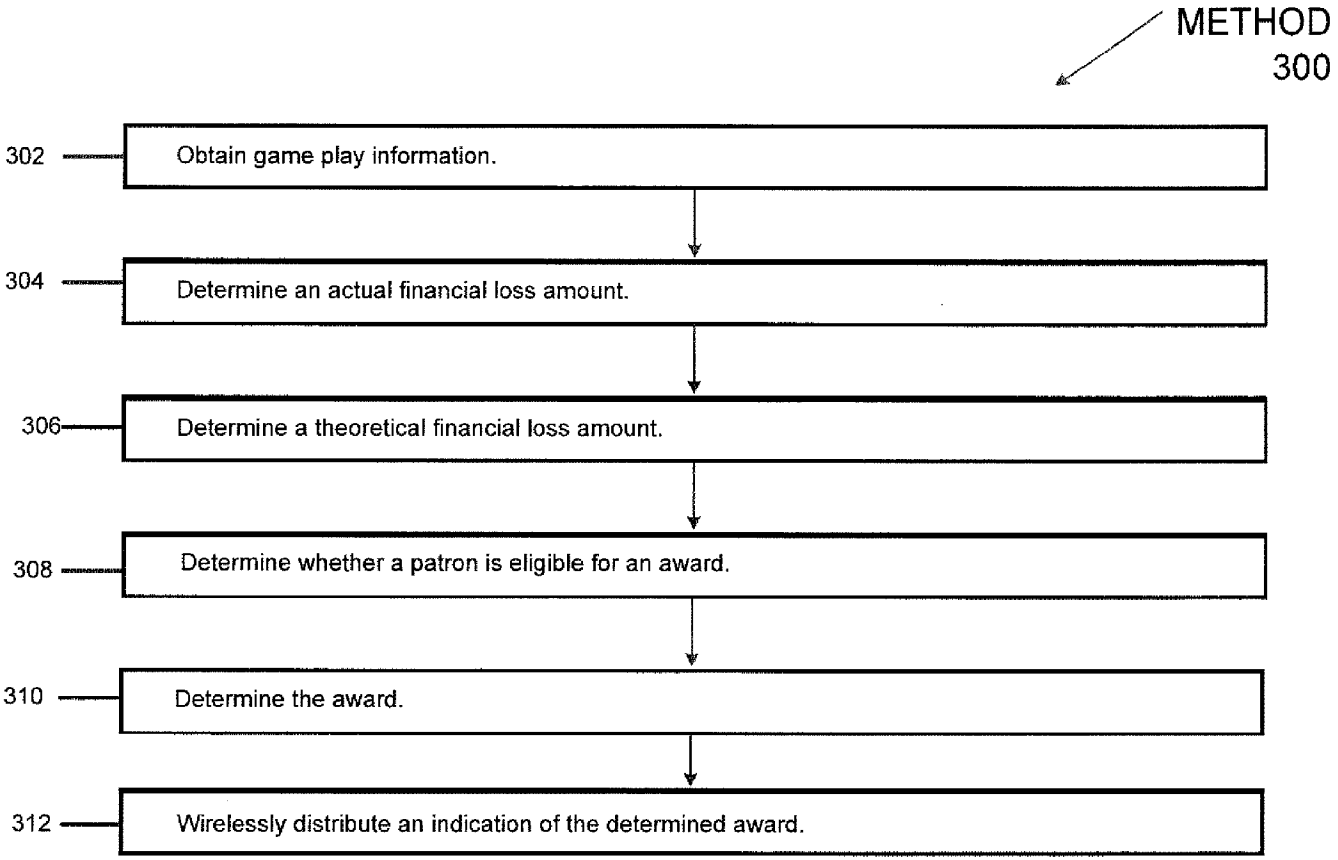
FIG. 3 illustrates a method to award a gaming patron based on gaming session financial results of the patron.

FIG. 3 illustrates a method 300 to award a gaming patron based on gaming session financial results of the patron. The operations of method 300 presented below are intended to be illustrative. In some implementations, method 300 may be accomplished with one or more additional operations not described, and/or without one or more of the operations discussed. Additionally, the order in which the operations of method 300 are illustrated in FIG. 3 and described below is not intended to be limiting. For example, two or more of the operations may occur substantially simultaneously.

In some implementations, method 300 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 300 in response to instructions stored electronically on one or more electronic storage mediums. The one or more processing devices may include one or more devices configured through hardware, firmware, and/or software to be specifically designed for execution of one or more of the operations of method 300.

At an operation 302, game play information may be obtained. The game play information may be related to game play by the patron during the gaming session. The game play information may be obtained via output signals from one or more game play sensors, and/or other sources. In some implementations, the game play information may be related to game play by the patron during a land-based casino gaming session, an online gaming session, and/or other gaming sessions. In some implementations, operation 302 may be performed by a processor module the same as or similar to tracking module 30 (shown in FIG. 1 and described herein).

At an operation 304, an actual financial loss amount may be determined. The actual financial loss amount may be determined from the obtained game play information and/or other information. In some implementations, operation 304 may be performed by a processor module the same as or similar to actual loss module 32 (shown in FIG. 1 and described herein).

At an operation 306, a theoretical financial loss amount may be determined. The theoretical financial loss amount may be determined from the game play information and/or other information. The theoretical financial loss amount may be representative of the mathematical odds of games played by the patron during the gaming session, wagers by the patron during the gaming session, and/or other information. In some implementations, operation 306 may be performed by a processor module the same as or similar to theoretical loss module 34 (shown in FIG. 1 and described herein).

At an operation 308, the eligibility of the patron for an award may be determined. The eligibility of the patron for the award may be determined based on the actual financial loss amount, the theoretical financial loss amount, and/or other information. Determining whether the patron is eligible for an award may include determining a first eligibility parameter based on the theoretical financial loss amount and comparing the first eligibility parameter to a first eligibility threshold value. In some implementations, the first eligibility parameter may be the theoretical financial loss amount. The first eligibility threshold value may be a pre-determined theoretical financial loss minimum eligibility value that is programmed at manufacture, obtained via external resources (e.g., external resources 24 shown in FIG. 1), and/or obtained by other methods.

Determining whether the patron is eligible for an award may include, responsive to the first eligibility parameter breaching the first eligibility threshold value, determining a second eligibility parameter based on the actual financial loss amount. In some implementations, the second eligibility parameter may be the actual financial loss amount. Determining whether the patron is available for an award may include comparing the second eligibility parameter to a second eligibility threshold value. The second eligibility threshold value may be determined based on the theoretical financial loss amount, the actual financial loss amount, and/or other information. In some implementations, the second eligibility threshold value may be an actual financial loss minimum eligibility value that is determined based on a ratio between the actual financial loss amount and the theoretical financial loss amount. The patron may be determined to be eligible for the award responsive to the first eligibility parameter (e.g. the theoretical financial loss amount) breaching the first eligibility threshold value (e.g., pre-determined theoretical financial loss minimum eligibility value) and the second eligibility parameter (e.g., the actual financial loss amount) breaching the second eligibility threshold value (e.g., the actual financial loss minimum eligibility value).

In some implementations, responsive to the first eligibility parameter not breaching the first eligibility threshold value, determining whether the patron is eligible for an award may include determining the second eligibility parameter (e.g., the actual financial loss amount) and comparing the second eligibility parameter to a third eligibility threshold value. The third eligibility threshold value may be a pre-determined minimum financial value that is programmed at manufacture, obtained via external resources (e.g., external resources 24 shown in FIG. 1), and/or obtained by other methods. The patron may be determined to be eligible for the award responsive to the second eligibility parameter breaching the third eligibility threshold value.

In some implementations, determining whether the patron is eligible for an award may include determining whether one or more session eligibility parameters satisfy one or more session eligibility criteria. A first session eligibility parameter and a first session eligibility criteria may be related to an amount of time between playing individual games (e.g., games 14 shown in FIG. 1) during a gaming session. A second session eligibility parameter and a second session eligibility criteria may be related to a number of games played during a gaming session. For example, operation 308 may include determining whether the patron has exceeded a given number of periods of game play (e.g., three) on the same individual game 14 and/or on multiple individual games 14, wherein a start time of one period of play was not within a given amount of time (e.g., five minutes) of the end time of the previous period of play. In some implementations, the patron may be determined to be eligible for the award responsive to one or more of the session eligibility parameters satisfying one or more of the session eligibility criteria. Thus, a gaming session for which a patron's eligibility for an award is determined may be limited to a number of individual games played and/or an allowable amount of time between games, for example. In some implementations, the determination of whether one or more of the session eligibility parameters satisfied one or more of the session eligibility criteria may be made after the determinations related to the first, second, and/or third eligibility thresholds described above. In some implementations, operation 308 may be performed by a processor module the same as or similar to trigger module 36 (shown in FIG. 1 and described herein).

At an operation 310, the award may be determined. The award may be determined responsive to a determination that the patron is eligible for the award. The award determined for the patron may be related to a percentage of the difference between the actual financial loss amount and the theoretical financial loss amount, a percentage of the actual financial loss amount, and/or other awards. In some implementations, operation 310 may be performed by a processor module the same as or similar to award module 38 (shown in FIG. 1 and described herein).

At an operation 312, an indication of the determined award may be wirelessly distributed. The indication of the determined award may be wirelessly distributed to the patron via a mobile computing device associated with the patron, for example. In some implementations, operation 312 may be performed by a processor module the same as or similar to distribution module 40 (shown in FIG. 1 and described herein).

Returning to FIG. 1, mobile computing device 20 may be associated with gaming patron 12. Mobile computing device 20 may include one or more processors, a user interface, electronic storage, and/or other components. Mobile computing device 20 may be configured to enable patron 12 to interface with system 10, and/or provide other functionality attributed herein to mobile computing device 20. Mobile computing device 20 may be configured to communicate with processor 18, external resources 24, and/or other components of system 10 via a network such as the internet, a cellular network, a Wi-Fi network, and/or other networks. Mobile computing device 20 may facilitate viewing of the information obtained and/or determined by processor 18, the indication of the award distributed by distribution module 40, the information stored by electronic storage 22, information provided by external resources 24, and/or other information. By way of non-limiting example, mobile computing device 20 may include one or more of a laptop computer, a handheld computer, a tablet computing platform, a NetBook, a gaming console, a smartphone, and/or other computing platforms. In some implementations, mobile computing device 20 may be the personal smartphone of gaming patron 12.

Electronic storage 22 may comprise electronic storage media that electronically stores information. The electronic storage media of electronic storage 22 may comprise one or both of system storage that is provided integrally (i.e., substantially non-removable) with system 10 and/or removable storage that is removably connectable to system 10 via, for example, a port (e.g., a USB port, a firewire port, etc.) or a drive (e.g., a disk drive, etc.). Electronic storage 22 may comprise one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage 22 may store software algorithms, information obtained and/or determined by processor 18 (e.g., player information, game play information, actual/theoretical financial loss information, award information), information received via mobile computing device 20, and/or other information that enables system 10 to function properly. Electronic storage 22 may be (in whole or in part) a separate component within system 10, or electronic storage 22 may be provided (in whole or in part) integrally with one or more other components of system 10 (e.g., processor 18).

External resources 24 may include sources of information (e.g., a game play information database), external entities participating with system 10 (e.g., a casino management system), a system server, a user interface, and/or other resources. In some implementations, some or all of the functionality attributed herein to external resources 24 may be provided by resources included in system 10. Game play sensors 16, processor 18, mobile computing device 20, electronic storage 22, and/or external resources 24 may be operatively linked via one or more electronic communication links. For example, such electronic communication links may be established, at least in part, via a network such as the internet and/or other networks. It will be appreciated that this is not intended to be limiting, and that the scope of this disclosure includes implementations in which external resources 24 may be operatively linked to one or more other components of system 10 via some other communication media, or with linkages not shown in FIG. 1.

As described above, processor 18 may be configured to provide information processing capabilities in system 10. As such, processor 18 may comprise one or more of a digital processor, an analog processor, a digital circuit designed to process information, an analog circuit designed to process information, a state machine, and/or other mechanisms for electronically processing information. Although processor 18 is shown in FIG. 1 as a single entity, this is for illustrative purposes only. In some implementations, processor 18 may comprise a plurality of processing units. These processing units may be physically located within the same device (e.g., a system server), or processor 18 may represent processing functionality of a plurality of devices operating in coordination.

Processor 18 may be configured to execute modules 30, 32, 34, 36, 38, and/or 40 by software; hardware; firmware; some combination of software, hardware, and/or firmware; and/or other mechanisms for configuring processing capabilities on processor 18. It should be appreciated that although modules 30, 32, 34, 36, 38, and 40 are illustrated in FIG. 1 as being co-located within a single processing unit, in implementations in which processor 18 comprises multiple processing units, one or more of modules 30, 32, 34, 36, 38, and/or 40 may be located remotely from the other modules. The description of the functionality provided by the different modules 30, 32, 34, 36, 38, and/or 40 described herein is for illustrative purposes, and is not intended to be limiting, as any of modules 30, 32, 34, 36, 38, and/or 40 may provide more or less functionality than is described. For example, one or more of modules 30, 32, 34, 36, 38, and/or 40 may be eliminated, and some or all of its functionality may be provided by other modules 30, 32, 34, 36, 38, and/or 40. As another example, processor 18 may be configured to execute one or more additional modules that may perform some or all of the functionality attributed below to one of modules 30, 32, 34, 36, 38, and/or 40.

In some implementations, processor 18, electronic storage 22, and/or other components may be, and/or be included in a system server (e.g., external resources 24). The server may include communication lines, or ports to enable the exchange of information with a network, mobile computing device 20, and/or other computing platforms. The server may include a plurality of processors, electronic storage, hardware, software, and/or firmware components operating together to provide the functionality attributed herein to processor 18, electronic storage 22, and/or other components of system 10. For example, the server may be implemented by a cloud of computing platforms operating together as a system server.

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system configured to award a gaming patron based on gaming session financial results of the patron, the system comprising:

one or more hardware processors configured by machine-readable instructions to:

obtain game play information related to game play by the patron during a gaming session;

determine, from the obtained game play information, an actual financial loss amount lost by the patron during the gaming session;

determine, from the obtained game play information, a theoretical financial loss amount by the patron for the gaming session, the theoretical financial loss amount being representative of mathematical odds of games played by the patron during the gaming session and wagers by the patron during the gaming session;

determine whether the patron is eligible for an award based on the actual financial loss amount and the theoretical financial loss amount; and responsive to a determination that the patron is eligible for the award, determine the award for the patron.

2. The system of claim 1, wherein the one or more hardware processors are further configured by machine-readable instructions to wirelessly distribute an indication of the determined award to the patron via a mobile computing device associated with the patron.

3. The system of claim 1, wherein the one or more hardware processors are further configured by machine-readable instructions to:

determine a first eligibility parameter based on the theoretical financial loss amount;

compare the first eligibility parameter to a first eligibility threshold value;

determine a second eligibility parameter based on the actual financial loss amount responsive to the first eligibility parameter breaching the first eligibility threshold value;

compare the second eligibility parameter to a second eligibility threshold value, the second eligibility threshold value determined based on the theoretical financial loss amount and the actual financial loss amount; and determine that the patron is eligible for the award responsive to the second eligibility parameter breaching the second eligibility threshold value.

4. The system of claim 3, wherein the one or more hardware processors are further configured by machine-readable instructions to:

responsive to the first eligibility parameter not breaching the first eligibility threshold value:

determine the second eligibility parameter and compare the second eligibility parameter to a third eligibility threshold value; and determine that the patron is eligible for the award responsive to the second eligibility parameter breaching the third eligibility threshold value.

5. The system of claim 4, wherein the one or more hardware processors are further configured by machine-readable instructions such that the first eligibility parameter is the theoretical financial loss amount and the second eligibility parameter is the actual financial loss amount.

6. The system of claim 1, wherein the one or more hardware processors are further configured by machine-readable instructions such that the award determined for the patron is related to a percentage of the difference between the actual financial loss amount and the theoretical financial loss amount.

7. The system of claim 1, wherein the one or more hardware processors are further configured by machine-readable instructions such that the determination of whether the patron is eligible for the award is based on a ratio between the actual financial loss amount and the theoretical financial loss amount.

8. The system of claim 1, wherein the one or more hardware processors are further configured by machine-readable instructions to obtain the game play information via output signals from one or more game play sensors.

9. The system of claim 1, wherein the one or more hardware processors are further configured by machine-readable instructions to obtain game play information related to game play by the patron during a land-based casino gaming session.

10. The system of claim 1, wherein the one or more hardware processors are further configured by machine-readable instructions to obtain game play information related to game play by the patron during an online gaming session.

11. The system of claim 1, wherein the one or more hardware processors are further configured by machine-readable instructions such that the theoretical financial loss amount is determined by multiplying a total amount wagered by a house advantage, or by multiplying the total amount wagered by one minus a return to player (RTP).

12. A method to award a gaming patron based on gaming session financial results of the patron, the method comprising:

using the one or more hardware processors to obtain game play information related to game play by the patron during a gaming session;

using the one or more hardware processor to determine, from the obtained game play information, an actual financial loss amount lost by the patron during the gaming session;

using the one or more hardware processor to determine, from the obtained game play information, a theoretical financial loss amount by the patron for the gaming session, the theoretical financial loss amount being representative of mathematical odds of games played by the patron during the gaming session and wagers of the patron during the gaming session;

using the one or more hardware processor to determine whether the patron is eligible for an award based on the actual financial loss amount and the theoretical financial loss amount; and using the one or more hardware processor to determine, responsive to a determination that the patron is eligible for the award, the award for the patron.

13. The method of claim 12, further comprising wirelessly distributing an indication of the determined award to the patron via a mobile computing device associated with the patron.

14. The method of claim 12, further comprising:

determining a first eligibility parameter based on the theoretical financial loss amount;

comparing the first eligibility parameter to a first eligibility threshold value;

determining a second eligibility parameter based on the actual financial loss amount responsive to the first eligibility parameter breaching the first eligibility threshold value;

comparing the second eligibility parameter to a second eligibility threshold value, the second eligibility threshold value determined based on the theoretical financial loss amount and the actual financial loss amount; and determining that the patron is eligible for the award responsive to the second eligibility parameter breaching the second eligibility threshold value.

15. The method of claim 14, further comprising:

responsive to the first eligibility parameter not breaching the first eligibility threshold value:

determining the second eligibility parameter and comparing the second eligibility parameter to a third eligibility threshold value; and determining that the patron is eligible for the award responsive to the second eligibility parameter breaching the third eligibility threshold value.

16. The method of claim 15, wherein the first eligibility parameter is the theoretical financial loss amount and the second eligibility parameter is the actual financial loss amount.

17. The method of claim 12, wherein the award determined for the patron is related to a percentage of the difference between the actual financial loss amount and the theoretical financial loss amount.

18. The method of claim 12, wherein the award determined for the patron is a percentage of the actual financial loss amount.

19. The method of claim 12, further comprising obtaining the game play information via output signals from one or more game play sensors.

20. The method of claim 12, further comprising obtaining game play information related to game play by the patron during a land-based casino gaming session.

21. The method of claim 12, further comprising obtaining game play information related to game play by the patron during an online gaming session.

22. The method of claim 12, wherein the theoretical financial loss amount is determined by multiplying a total amount wagered by a house advantage, or by multiplying the total amount wagered by one minus a return to player (RTP).

* * * * *